US006419373B1

(12) United States Patent
Shieh

(10) Patent No.: US 6,419,373 B1
(45) Date of Patent: Jul. 16, 2002

(54) FOLDABLE DECORATIVE LIGHT ASSEMBLY

(76) Inventor: Whiter Shieh, 6F, No. 245, Tun Hua South Road , Sec. 1, Taipei, 106, Taiwan, R.O.C., Taipei (TW)

( * ) Notice: Subject to any disclaimer, the term of this patent is extended or adjusted under 35 U.S.C. 154(b) by 0 days.

(21) Appl. No.: 09/839,491

(22) Filed: Apr. 23, 2001

(51) Int. Cl.[7] ..... F21V 21/00

(52) U.S. Cl. ..... 362/249; 362/102; 362/252; 362/806; 362/809; 135/16

(58) Field of Search ..... 362/102, 807, 362/808, 809, 249, 806, 250, 252; 135/16, 910

(56) References Cited

U.S. PATENT DOCUMENTS 3,851,164 A * 11/1974 Intrator ..... 240/1.3
5,876,111 A * 3/1999 Wu ..... 362/250
5,890,506 A * 4/1999 Kupferman ..... 135/33.2
5,954,417 A * 9/1999 Mai ..... 362/102

* cited by examiner

*Primary Examiner*—Stephen Husar
*Assistant Examiner*—Guiyoung Lee
(74) *Attorney, Agent, or Firm*—Rosenberg, Klein & Lee

(57) ABSTRACT

A foldable decorative light assembly includes a central post, an umbrella-shaped foldable supporting frame mounted on the central post, a meshed covering covered on the umbrella-shaped foldable supporting frame. A light string including a plurality of light units is arranged on the meshed covering for decoration. The foldable supporting frame includes a runner moved along the central post, a plurality of resilient ribs respectively pivotally connected to the central post, and a plurality of stretchers respectively coupled between the runner and the resilient ribs. Two umbrella-shaped foldable supporting frames can be correspondingly coupled to form a globular foldable supporting frame.

8 Claims, 7 Drawing Sheets

FOLDABLE DECORATIVE LIGHT ASSEMBLY

BACKGROUND OF THE INVENTION

1. Field of the Invention

The present invention relates to a decorative light assembly and, more particularly to a foldable decorative light assembly.

2. Description of the Prior Art

During Christmas holidays or particular festival holidays, people usually decorate the houses with Christmas trees and a variety of decorative light strings. These Christmas trees occupy much storage space when not in use because they are not possible to be folded. When removing decorative light strings from Christmas trees, decorative light strings may be tangled with one another. Further, when preparing a party or the like, people tend to decorate the place with decorative light assemblies, for example, stage lights. However, these conventional decorative light assemblies are not attractive to people.

Thus, it is desired to have an improved decorative light tree that can be easily assembled and stored for overcoming the problems discussed above.

SUMMARY OF THE INVENTION

Accordingly, a primary object of the present invention is to provide a foldable decorative light assembly.

Another object of the present invention is to provide a foldable supporting frame for a decorative light assembly.

One more object of the present invention is to provide a foldable decorative light assembly including a light string arranged on the light assembly.

To achieve the above objects, in accordance with the present invention, there is provided a foldable decorative light assembly including a central post, an umbrella-shaped foldable supporting frame mounted on the central post, a meshed covering covered on the umbrella-shaped foldable supporting frame. A light string including a plurality of light units is arranged on the meshed covering for decoration. The foldable supporting frame includes a runner moved along the central post, a plurality of resilient ribs respectively pivotally connected to the central post, and a plurality of stretchers respectively coupled between the runner and the resilient ribs.

Alternatively, two corresponding umbrella-shaped foldable supporting frames may be coupled to form a globular decorative light assembly. Each of the umbrella-shaped foldable supporting frame is composed of a runner moved along said central post, a plurality of resilient ribs, and a plurality of stretchers.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
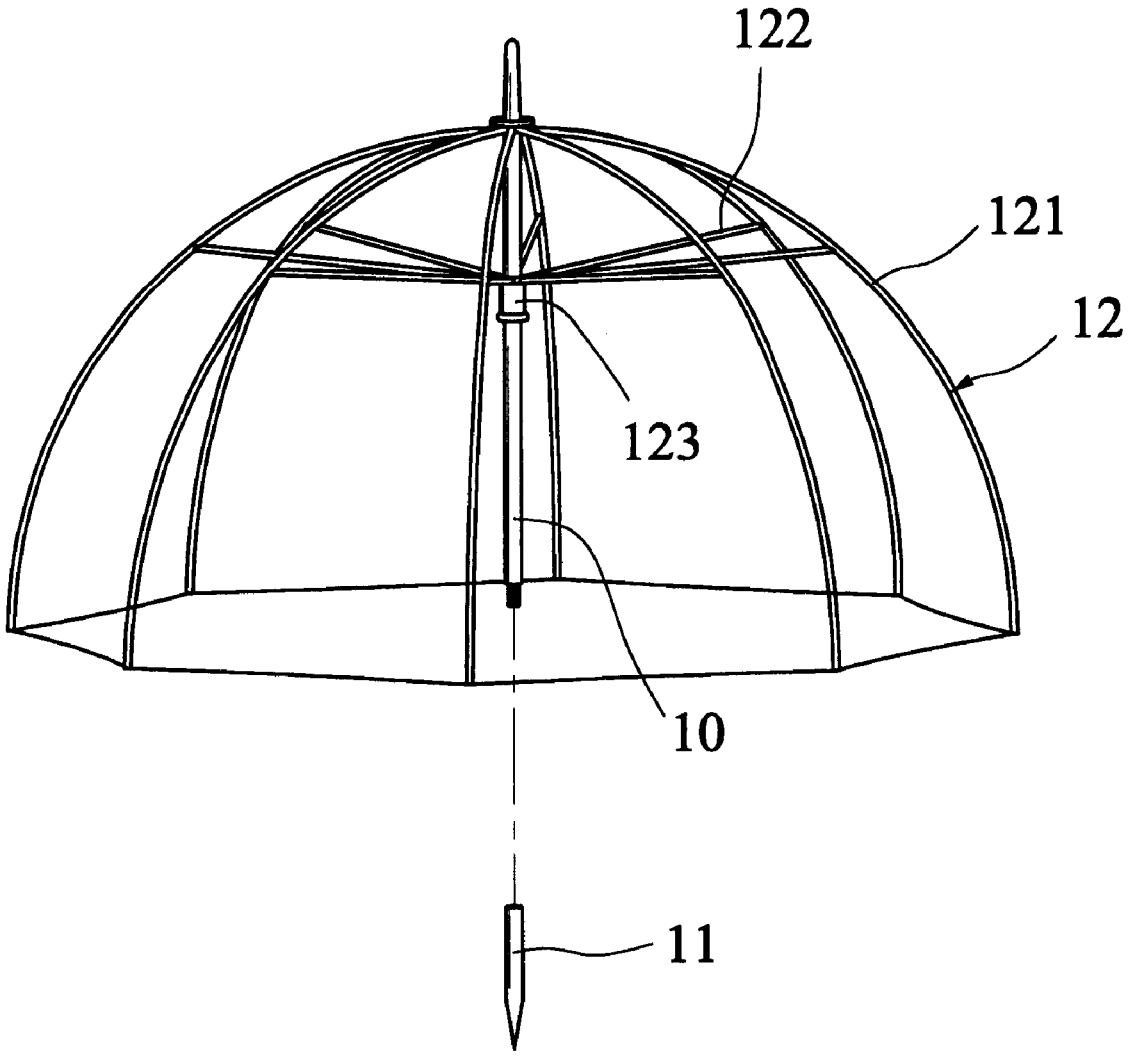
FIG. 1 illustrates an umbrella-shaped foldable supporting frame of the decorative light assembly according to a first embodiment of the present invention.
Figure 2:
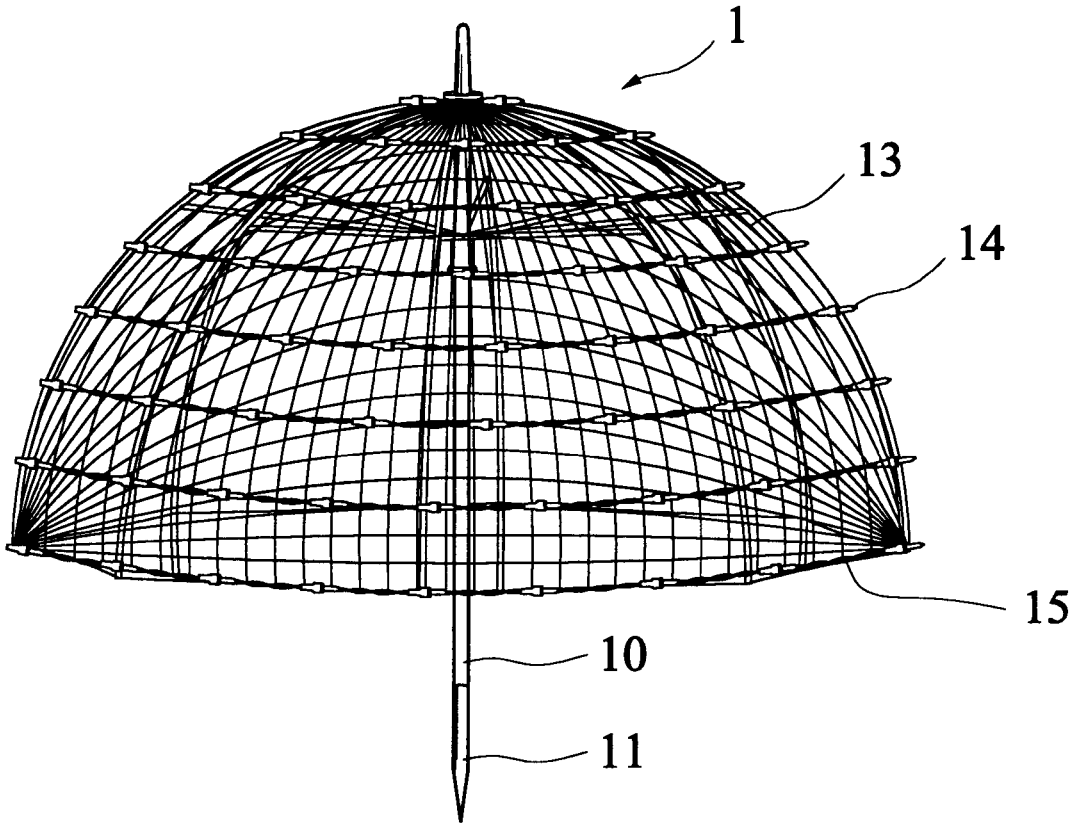
FIG. 2 shows that a meshed covering and a light string are arranged on the foldable supporting frame of the first embodiment of the present invention, and a tapered rod member is further mounted on a bottom end of a central post of the decorative light assembly.
Figure 4:
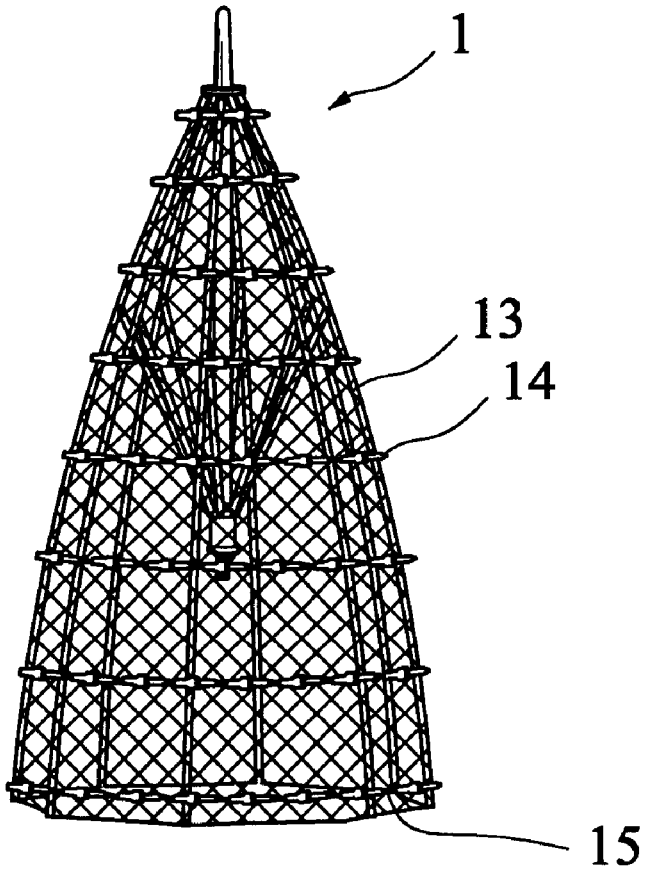
FIG. 4 shows the decorative light assembly of the first embodiment of the present invention is folded.

Referring to FIG. 1, it illustrates an umbrella-shaped foldable supporting frame of the decorative light assembly according to a first embodiment of the present invention. The umbrella-shaped foldable decorative light assembly 1 of the present invention comprises a rigid central post 10 having a top end and a bottom end. An anchoring member, for example a tapered rod member 11, may be mounted to the bottom end of the central post 10 for fastening into earth. An umbrella-shaped foldable supporting frame 12 may either in an extended status as shown in FIG. 2 or in a folded status as shown in FIG. 4. The umbrella-shaped foldable supporting frame 12 may be mounted on the top end of the central post 10.

In a preferred embodiment of the present invention, the umbrella-shaped foldable supporting frame 12 comprises a runner 123 moved along the central post 10, a plurality of resilient ribs 121, and a plurality of stretchers 122. Each of the resilient ribs 121 has a top end pivotally connected to the top end of the central post 10. Each of the stretchers 122 has one end pivotally connected to the runner 123 and an opposite end pivotally connected to a middle part of one resilient rib 121.

When moving the runner 123 upwardly along the central post 10 toward the topside, the stretchers 122 are moved with the runner 123 to extend out the resilient ribs 121, and therefore the foldable supporting frame 12 is extended.

FIG. 2 shows that a meshed covering 13 is covered on the foldable supporting frame 12. The covering 13 may be made of polyvinyl chloride fabrics or metal wires. A plurality of light units 14 may be arranged on the covering 13, connected by electric wires 15 to form a light string.

A tapered rod member 11 may be further mounted on the bottom end of the central post 10 of the decorative light assembly 1. After installation of the tapered rod member 11, the foldable decorative light assembly I can be fastened to ground with the tapered rod member 11.

Figure 3:
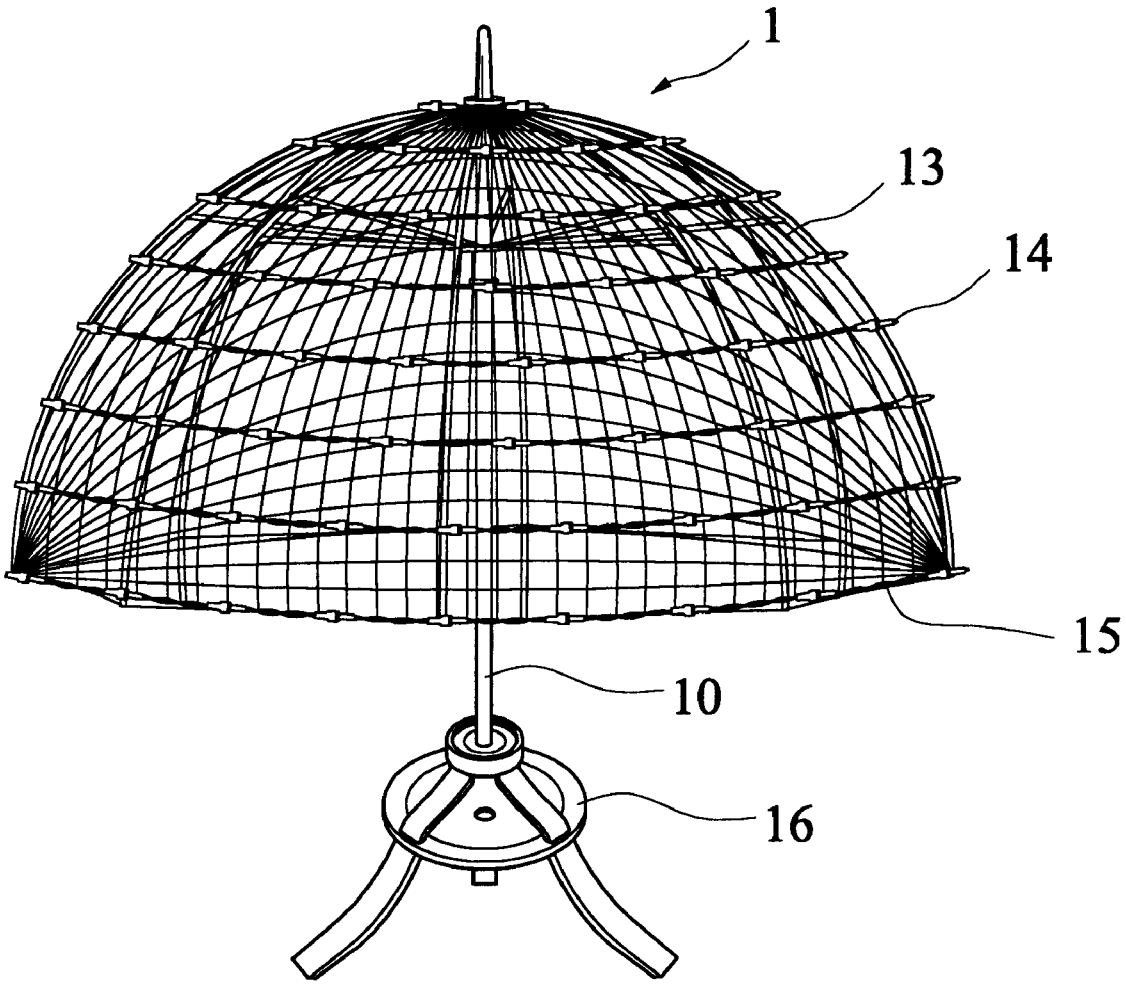
FIG. 3 shows that a meshed covering and a light string are arranged on the foldable supporting frame of the first embodiment of the present invention, and a stand is further mounted on a bottom end of a central post of the decorative light assembly.

Referring to FIG. 3, a stand 16 may be used and mounted to the bottom end of the central post 10 instead of the aforesaid tapered rod member 11. The stand 16 can be used to support the foldable decorative light assembly 1 on floor.

When moving the runner 123 downwardly toward the bottom side, the stretchers 122 are lowered with the runner 123 to pull the resilient ribs 121 toward the central post 10, and therefore the foldable supporting frame 12 may be folded, as shown in FIG. 4.

Figure 5:
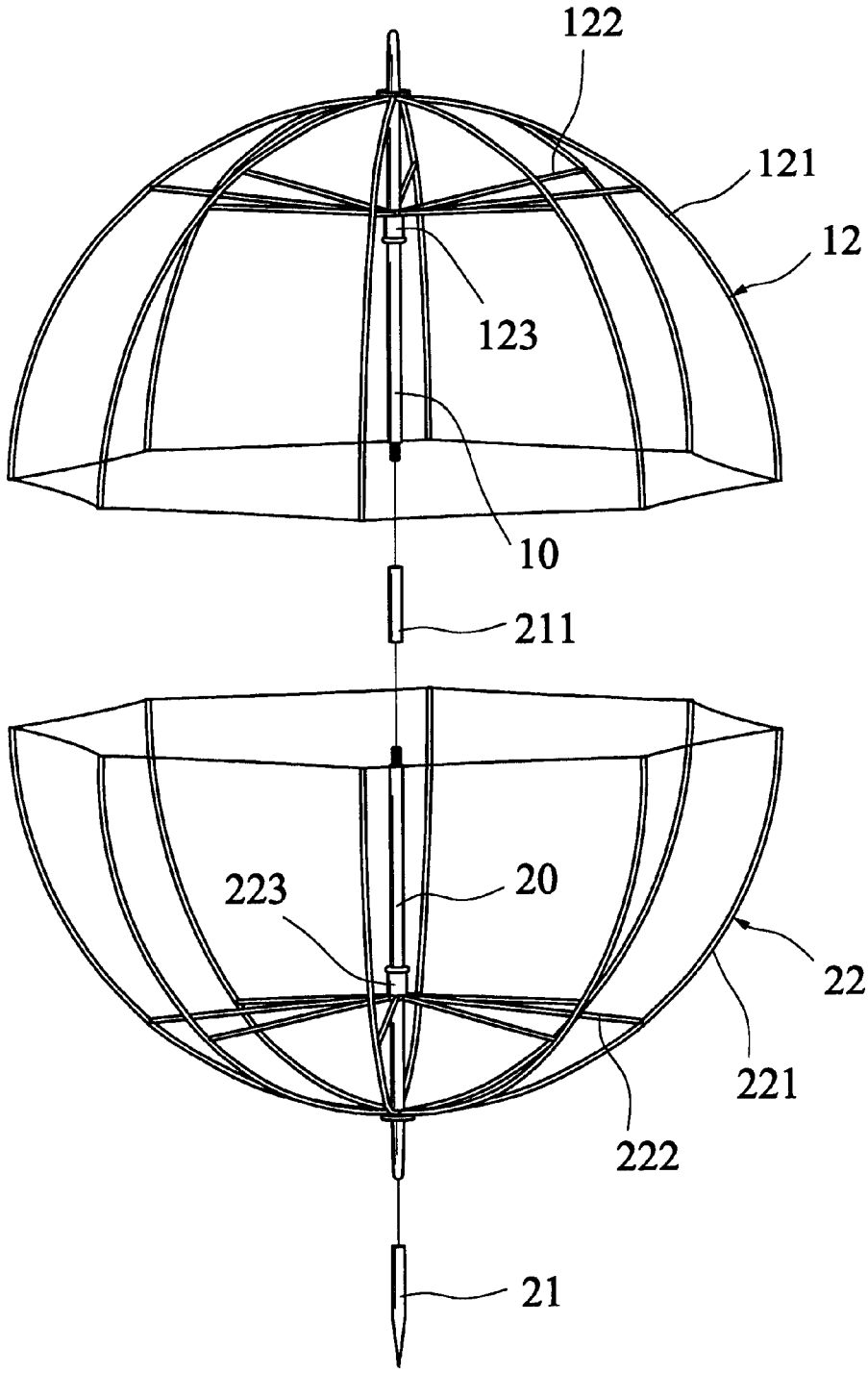
FIG. 5 is an exploded view showing the decorative light assembly is composed of two umbrella-shaped foldable supporting frame in accordance with a second embodiment of the present invention.
Figure 6:
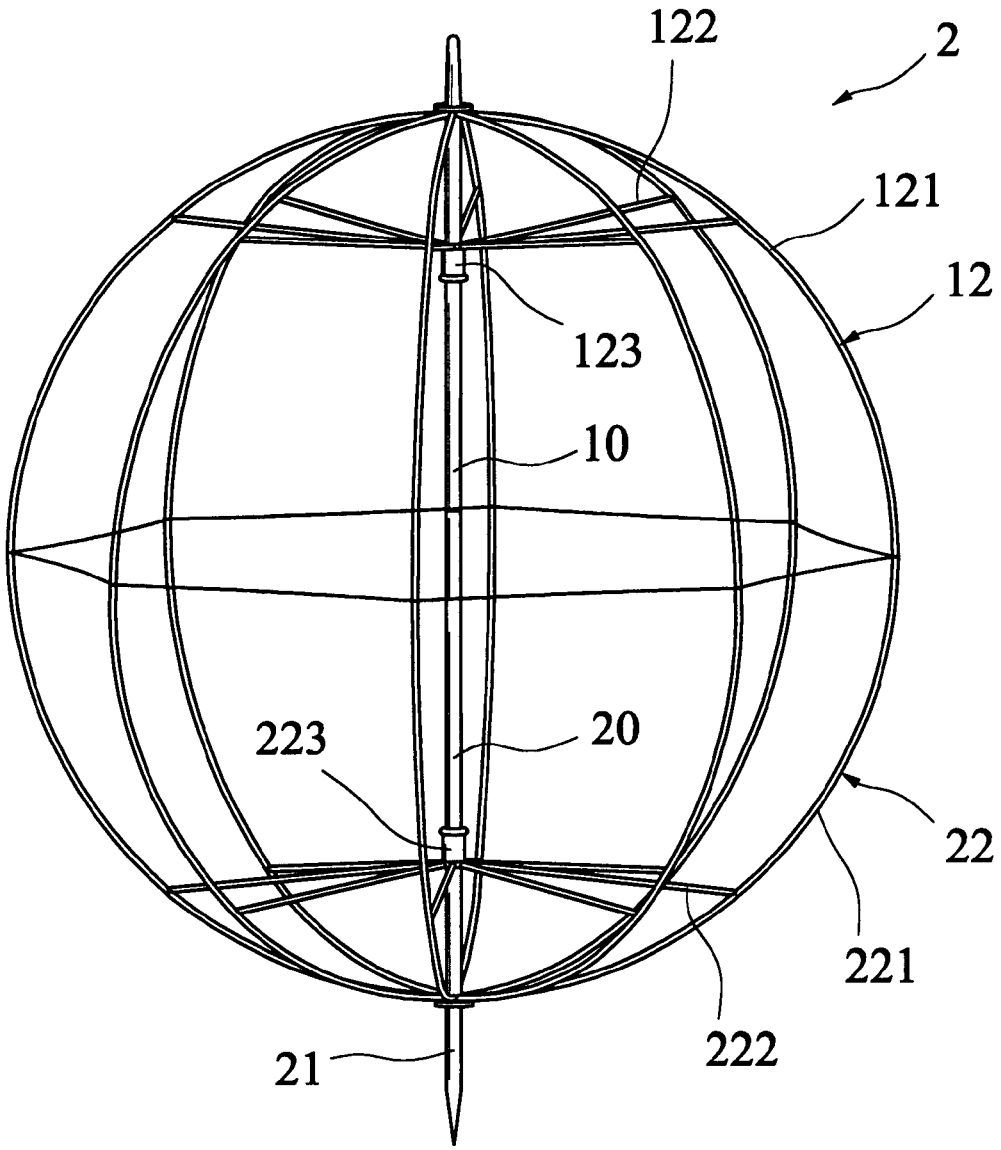
FIG. 6 is perspective view showing two umbrella-shaped foldable supporting frames are correspondingly coupled to form a globular decorative light assembly in accordance with the second embodiment of the present invention.
Figure 7:
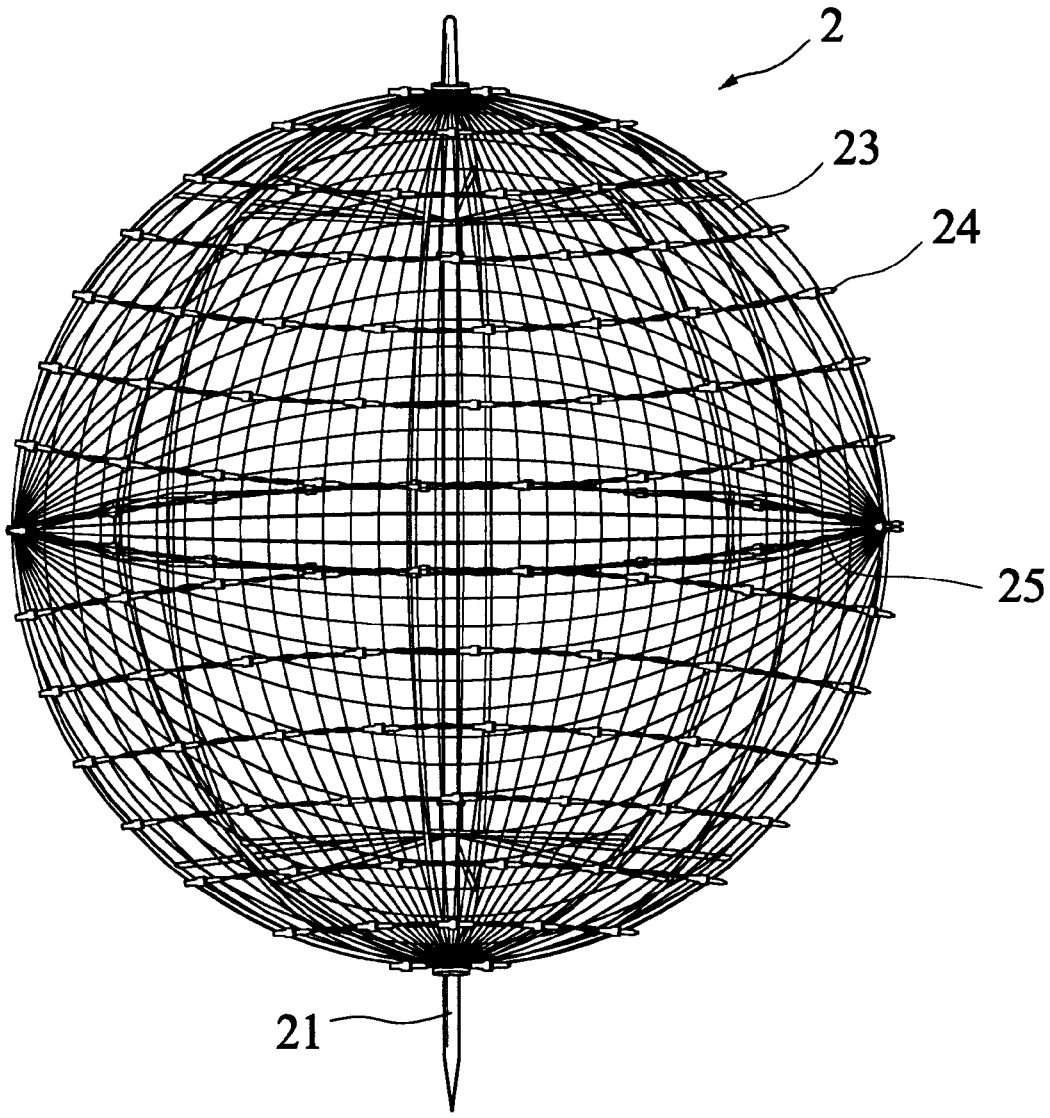
FIG. 7 shows that a meshed covering and a light string are arranged on the foldable supporting frame of the second embodiment of the present invention.

With reference to FIGS. 5 through 7, a globular foldable decorative light assembly 2 according to a second embodiment of the present invention is shown. According to this embodiment, the foldable decorative light assembly 2 has a globular shape when extended.

As illustrated, the globular foldable decorative light assembly 2 is composed of two corresponding umbrella-shaped foldable light assemblies. Same to the umbrella-shaped foldable light assembly of the previous embodiment, the first umbrella-shaped foldable light assembly of the second embodiment comprises a first central post 10 having a top end and a bottom end. A first umbrella-shaped foldable supporting frame 12 may be mounted on the top end of the first central post 10. The first umbrella-shaped foldable supporting frame 12 comprises a first runner 123 moved along the first central post 10, a plurality of first resilient ribs 121, and a plurality of first stretchers 122. Each of the resilient ribs 121 has a top end pivotally connected to the top end of the first central post 10. Each of the stretchers 122 has one end pivotally connected to the first runner 123 and an opposite end pivotally connected to a middle part of one resilient rib 121.

The second umbrella-shaped foldable light assembly of the second embodiment comprises a second central post 20 having a top end and a bottom end. A second umbrella-shaped foldable supporting frame 22 may be mounted on the top end of the second central post 20. The second umbrella-shaped foldable supporting frame 22 comprises a second runner 223 moved along the second central post 20, a plurality of second resilient ribs 221, and a plurality of second stretchers 222. Each of the resilient ribs 221 has a top end pivotally connected to the top end of the second central post 20. Each of the stretchers 222 has one end pivotally connected to the second runner 223 and an opposite end pivotally connected to a middle part of one resilient rib 221.

A connection rod 211 may be detachably connected between the first central post 10 and the second central post 20 for correspondingly coupling the first umbrella-shaped foldable supporting frame 12 and the second umbrella-shaped foldable supporting frame 22 together to form a globular decorative light assembly. Further, a tapered rod member 21 may be connected to the bottom end of the second central post 20 for fastening the decorative light assembly to ground.

A meshed covering 23 is covered both on the first umbrella-shaped foldable supporting frame 12 and the second umbrella-shaped foldable supporting frame 22. A plurality of light units 24 may be arranged on the covering 23, connected by electric wires 25 to form a light string.

When not in use, the first central post 10 and the second central post 20 may be disconnected from the connection rod 211, and then the first foldable supporting frame 12 and the second foldable supporting frame 22 may be respectively collapsed.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A foldable decorative light assembly comprising:

a central post having a top end and a bottom end;

at least one umbrella-shaped foldable supporting frame mounted on said top end of the central post;

a collapsible meshed covering externally enshrouding said umbrella-shaped foldable supporting frame, said meshed covering in an expanded configuration describing a substantially dome-shaped contour; and a light string secured to said meshed covering, said light string including a plurality of light units disposed therealong for distributed arrangement on said meshed covering.

2. The foldable decorative light assembly of claim 1, further comprising a rod member connected to the bottom end of said central post, the rod member having a tapered bottom end.

3. The foldable decorative light assembly of claim 1, further comprising a stand mounted on the bottom end of the central post.

4. The foldable decorative light assembly of claim 1, wherein said umbrella-shaped foldable supporting frame comprises a runner moved along said central post, a plurality of resilient ribs, said resilient ribs each having a top end pivotally connected to the top end of said central post, and a plurality of stretchers coupled between said runner and said resilient ribs, said stretchers each having one end pivotally connected to said runner and an opposite end pivotally connected to a middle part of one resilient rib.

5. A foldable decorative light assembly comprising:

a central post portion having a top end and a bottom end;

a globular foldable supporting frame supported between the top end and the bottom end of the central post portion;

a collapsible meshed covering externally enshrouding said globular foldable supporting frame, said meshed covering in an expanded configuration describing a substantially spherical outer contour; and a light string secured to said meshed covering, said light string including a plurality of light units disposed therealong for distributed arrangement on said meshed covering.

6. The foldable decorative light assembly of claim 5, further comprising a rod member connected to the bottom end of said central post, the rod member having a tapered bottom end.

7. The foldable decorative light assembly of claim 5, further comprising a stand mounted on the bottom end of the central post.

8. The foldable decorative light assembly of claim 5, wherein said globular foldable supporting frame comprises two corresponding umbrella-shaped foldable supporting frames, each of the umbrella-shaped foldable supporting frame comprising a runner moved along said central post, a plurality of resilient ribs, said resilient ribs each having a top end pivotally connected to the top end of said central post, and a plurality of stretchers coupled between said runner and said resilient ribs, said stretchers each having one end pivotally connected to said runner and an opposite end pivotally connected to a middle part of one resilient rib.

* * * * *